United States Patent [19]

Patel

[11] Patent Number: 4,697,473

[45] Date of Patent: Oct. 6, 1987

[54] ROCKER ARM WITH CAM-CONTACTING ROLLER

[75] Inventor: Ramanlal L. Patel, Maumee, Ohio

[73] Assignee: The Henley Group, Inc., La Jolla, Calif.

[21] Appl. No.: 894,066

[22] Filed: Aug. 7, 1986

[51] Int. Cl.[4] ..... B23P 15/00; F01L 1/18; G05G 1/04

[52] U.S. Cl. ..... 74/519; 29/156.4 R; 123/90.39; 123/90.44; 74/559

[58] Field of Search ..... 74/519, 559, 523; 123/90.39, 90.41, 90.42, 90.44, 90.5; 29/156.4 R, 156.7 B

[56] References Cited

U.S. PATENT DOCUMENTS

| | | | |
|---|---|---|---|
| 2,322,172 | 6/1943 | Spencer | 123/90.44 |
| 2,905,161 | 9/1959 | Latham | 123/90.39 |
| 3,116,647 | 1/1964 | Leake | 74/519 |
| 3,142,357 | 7/1964 | Thompson | 74/519 |
| 3,198,183 | 8/1965 | Ball | 74/519 |
| 3,251,350 | 5/1966 | Thompson | 74/519 |
| 3,610,218 | 10/1971 | Durham | 74/519 |
| 3,621,823 | 11/1971 | Lombardi | 74/519 |
| 3,754,539 | 8/1973 | Bandimere | 74/519 |
| 4,182,290 | 1/1980 | Pohle | 74/519 |
| 4,369,740 | 1/1983 | Seidl | 123/90.44 |
| 4,430,783 | 2/1984 | Wherry | 123/90.39 |
| 4,624,223 | 11/1986 | Wherry et al. | 123/90.44 |
| 4,628,874 | 12/1986 | Barlow | 123/90.39 |

FOREIGN PATENT DOCUMENTS

| | | | |
|---|---|---|---|
| 130497 | 6/1932 | Austria | 123/90.39 |
| 966302 | 10/1950 | France | 123/90.39 |

*Primary Examiner*—Gary L. Smith
*Assistant Examiner*—Vinh Luong
*Attorney, Agent, or Firm*—Allen D. Gutchess, Jr.

[57] ABSTRACT

A one-piece, cold-formed rocker arm of the cam follower type is provided. The rocker arm includes a one-piece metal body cold-formed from a metal blank and being of inverted U-shaped cross section substantially throughout its length. The body has a top wall with depending, structurally integral side walls. An intermediate, convex portion of the top wall has a rectangular opening therein exceeding therethrough. A cam-contacting roller is rotatably mounted on an axle carried by the side walls below the rectangular opening. The roller has a circumferential surface extending upwardly through and beyond the rectangular opening to engage a cam. The rocker arm body has a rounded recess formed at one end portion to receive a lifter post on which the rocker arm can pivot. The body has an additional recess at another end portion to receive an end of a valve stem.

9 Claims, 6 Drawing Figures

ROCKER ARM WITH CAM-CONTACTING ROLLER

This invention relates to a rocker arm of the cam-follower type having a cam-contacting roller extending upwardly therefrom.

From a broad standpoint, rocker arms and other engine components have employed rollers in the past, as shown in the following U.S. Pat. Nos.: 2,322,172 and 2,322,173, issued Jun. 15, 1943; 2,385,309, issued Sept. 18, 1945; 2,506,566, issued May 9, 1950; and 3,139,870, issued July 7, 1964.

The rocker arm in accordance with the invention is of the cam-follower type and is made by cold-forming operations, including stamping, coining, staking, and back-packing. The rocker arm preferably includes a one-piece metal body which is of inverted U-shaped cross section substantially throughout its length. The body has a top wall with two structurally integral side walls depending therefrom throughout most of its length. The rocker arm body includes a rounded recess formed in one end portion to receive an upper end of a lifter post upon which the rocker arm can pivot. Another end portion of the rocker arm body has a second recess therein of rectangular cross section to receive an end of a valve stem. An intermediate portion of the top wall of the body is generally convex, facing upwardly away from the recesses. A middle part of the convex portion of the top wall has a rectangular opening extending therethrough with the length or longitudinal dimension of the rectangular opening being less than the length of the convex portion so that the convex portion exists beyond both ends of the rectangular opening. The width or transverse dimension of the rectangular opening is substantially equal to the width of the top wall so that the rectangular opening extends substantially completely from one side wall of the rocker arm body to the other.

A cam-contacting roller is rotatably carried by the rocker arm body and has a circumferential surface extending upwardly through the rectangular opening to engage a cam. The cam-contacting roller is rotatably mounted on an axle carried by the side walls of the body below the rectangular opening. The roller is rotatably mounted on the axle through a multiplicity of needle bearings to provide minimal friction.

The rocker arm with the cam-contacting roller has a number of advantages over rocker arms heretofore known. The rocker arm can have a lower profile than similar rocker arms heretofore employed, such as that shown in a co-pending application, Ser. No. 465,163, filed Feb. 9, 1983. The lower profile and compactness enables the new rocker arm to be embodied in low-profile engines with lower profile valve trains. The roller also minimizes friction between the rocker arm and the cam. This results in better fuel economy or, in the alternate, higher performance for the engine. The lesser friction also results in lower loads and enables the weight of the rocker arm to be reduced because stiffness is not as important. The cam-contacting roller also results in less wear because of the rolling contact instead of sliding contact.

It is, therefore, a principal object of the invention to provide a rocker arm of the cam-follower type having a cam-contacting roller with a circumferential surface extending upwardly therefrom to engage a cam above the rocker arm.

Another object of the invention is to provide a rocker arm with a cam-contacting roller having the advantages and features discussed above.

Other objects and advantages of the invention will be apparent from the following detailed description of a preferred embodiment thereof, reference being made to the accompanying drawings, in which.

Figure 1:
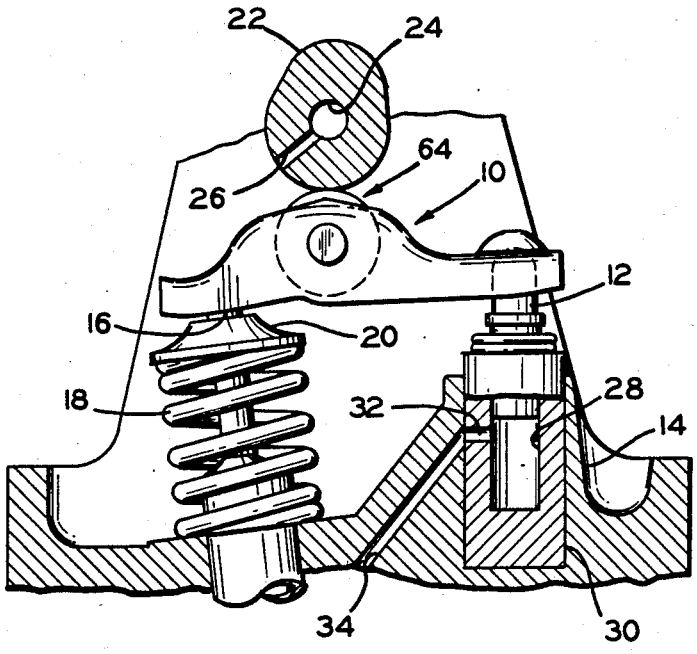
FIG. 1 is a somewhat schematic view in cross section, with portions in elevation, of valve-actuating mechanism including a rocker arm in accordance with the invention.
Figure 2:
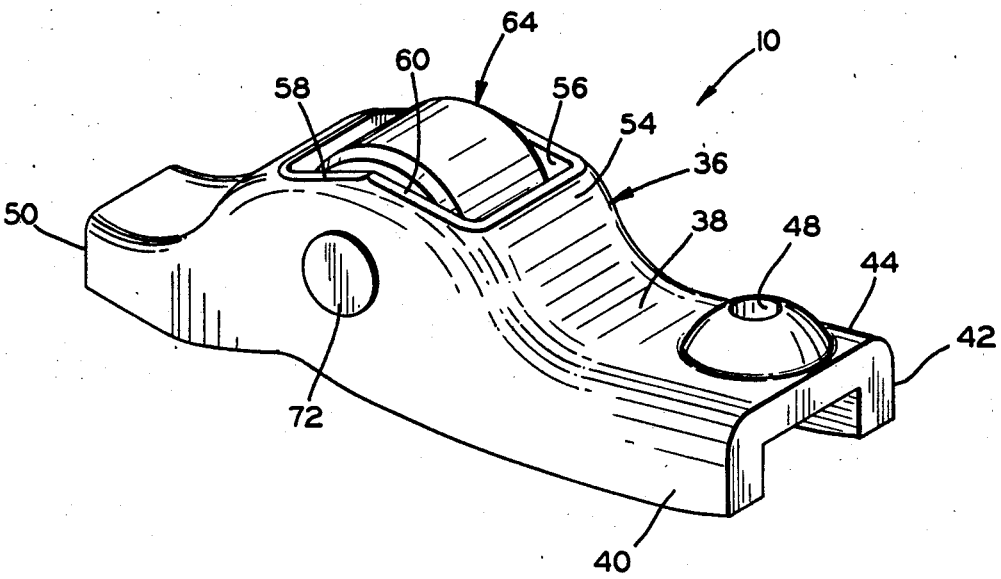
FIG. 2 is an enlarged view in perspective of the rocker arm of FIG. 1.

Referring particularly to FIG. 1, a rocker arm of the cam-follower type is indicated at 10 and has one end portion received on a rocker arm fulcrum or lifter post 12 extending upwardly from a cylinder head 14 of an internal combustion engine. The other end portion of the rocker arm 10 engages an upper end of a valve stem 16. The valve stem extends upwardly from the cylinder head 14 through a coiled compression spring 18 located therearound and which is seated against the cylinder head and against a retainer ring 20 mounted on the stem 16. An overhead cam 22 engages an intermediate portion of the rocker arm 10 to cause a valve located at the lower end of the valve stem 16 to open and close as the stem is moved longitudinally by the rocker arm 10. Oil or other lubricating fluid is supplied through a central passage 24 in the cam shaft of the cam 22 and to a transverse passage 26 from which it flows to the intermediate surface of the rocker arm 10 for lubricating purposes.

The lifter post or fulcrum 12 is slidably carried in a chamber 28 of a cylinder 30. The post 12 is urged upwardly by fluid such as oil under pressure in the chamber 28 which is supplied through a small port 32 from a supply passage 34. The post 12 thereby can yield somewhat when the cam 22 rotates. In practice, the post 12 moves down slightly at the high lobe of the cam 22 to provide a zero lash adjustment for the rocker arm 10. The port 32 is of a size to provide for controlled leakage of the oil from the chamber 28 to control pressure of the oil therein. Oil can also be supplied from the passage 34 up to the intermediate surface of the rocker arm 10 for lubricating purposes.

Referring more particularly to FIGS. 2–6, the rocker arm 10 includes a one-piece, cold-formed metal body 36 which is preferably made by cold-forming operations, such as stamping, coining, staking, and back-packing. The body 36 is of inverted U-shaped cross section substantially through its length and includes a top wall 38 with structurally-integral, depending side walls 40 and 42. A first end portion 44 of the body has a first, rounded recess 46 therein to receive the upper, rounded end of the lifter post 12. A lubricating or oil opening 48 formed through the upper wall 38 communicates with the rounded recess 48 and can provide a reservoir for oil which can be collected therein and supplied to the surfaces of the recess 46 and the lifter post 12.

A second end portion 50 of the body 36 has a second recess 52 therein of generally rectangular shape in transverse cross section with this recess being coined to maintain close tolerances when the recess receives the upper end of the valve stem 16. This prevents transverse or lateral motion of the rocker arm 10 during operation thereof.

Figure 3:
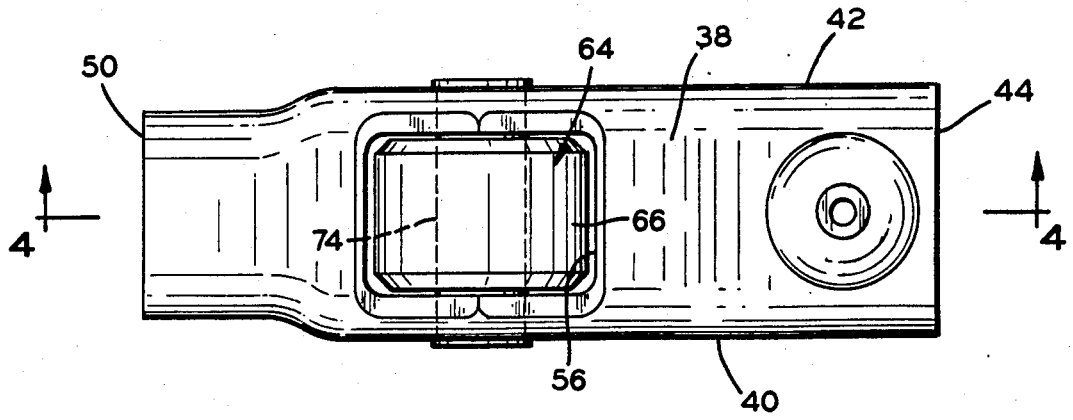
FIG. 3 is a top view of the rocker arm of FIG. 2.
Figure 4:
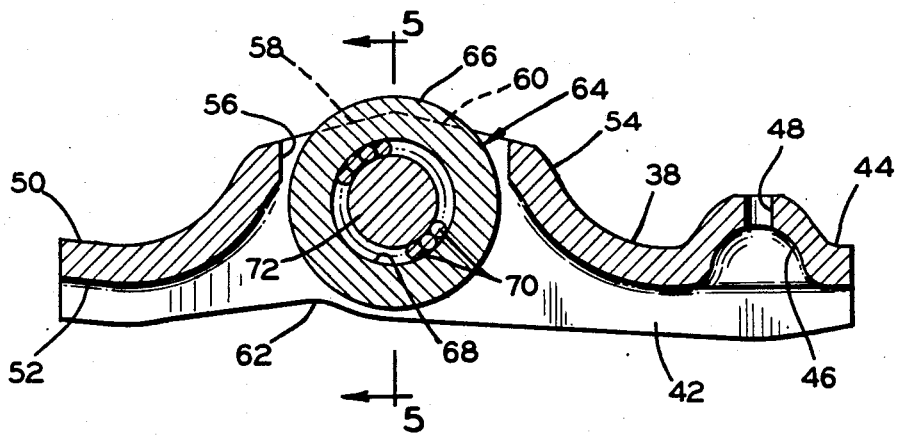
FIG. 4 is a view in longitudinal cross section taken along the line 4—4 of FIG. 3.
Figure 5:
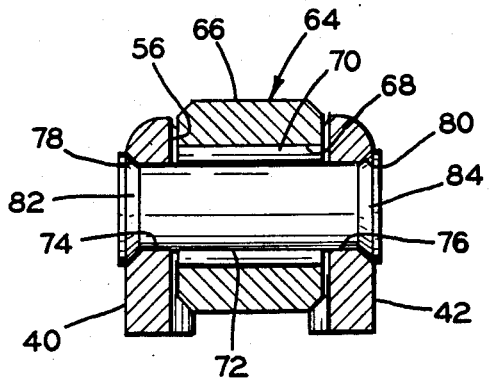
FIG. 5 is a view in transverse cross section taken along the line 5—5 of FIG. 4.
Figure 6:
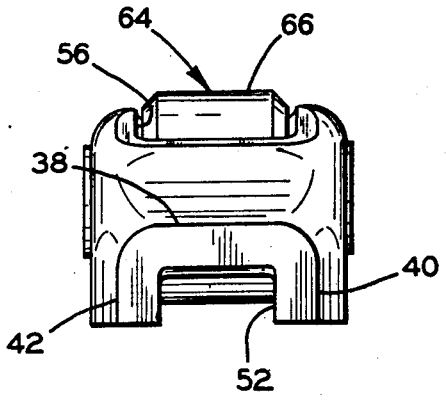
FIG. 6 is a left-end view of the rocker arm.

An intermediate portion 54 of the rocker arm body 36 is generally convex on top and concave on the bottom. A rectangular opening 56 is formed through the top wall 38 at a central area of the convex portion 54, the length or longitudinal dimension of the opening 56 being shorter than the extent of the convex portion 54 so as to leave part of the convex portion 54 at each end of the rectangular opening 56. The width or transverse dimension of the rectangular opening 56 is substantially equal to the width of the top wall 38 so as to extend completely between the inner surfaces of the side walls 40 and 42, as best shown in FIGS. 3 and 5. The upper edges of the side walls 40 and 42 at the longitudinal edges of the rectangular opening 56 are not straight but slant upwardly at 58 and 60 in FIG. 4 to a middle point of the longitudinal edges of the opening 56. This provides great cross-sectional area of the rocker arm body 36 at the convex portion 54 where the opening 56 is located to provide more strength and stiffness even though the metal of the top wall 58 is removed from the opening 56. This additional metal is also particularly important where the lower edges of the side walls 40 and 42 are recessed somewhat at shallow recesses 62, as shown in FIG. 4, to provide operating clearance for the rocker arm in certain engines.

A cam-contacting roller 64 is positioned between the side walls 40 and 42 of the rocker arm 10 and has a circumferential surface 66, a portion of which extends through the opening 56 and above the upper edges thereof. The width of the roller 64 is slightly less than the width or transverse dimension of the rectangular opening 56 and the diameter of the roller 64 is slightly less than the length or longitudinal dimension of the rectangular opening 56, as shown in FIG. 3. The diameter of the roller 64 is also such that the roller does not extend below the lower edges of the side walls 40 and 42, including the shallow recesses 62 thereof. Preferably, from one-fourth to one-third of the circumferential surface 66 of the roller 64 protrudes beyond the upper longitudinal edges of the rectangular opening 56.

The roller 64 also has a central bore 68 which receives and contains a multiplicity of needle bearings 70. The needle bearings 70 rotatably support the roller 64 on an axle 72 which constitutes an inner race for the needle bearings.

The axle 72 is received in two round holes 74 and 76 (FIG. 5) which are formed or pierced in the side walls 40 and 42 in axial alignment. Outer ends of the holes 74 and 76 are flared at 78 and 80 to receive enlarged or flared ends 82 and 84 of the axle 72. The ends 82 and 84 of the axle can be formed by staking or by a spinning process.

The use of the cam-contacting roller 64 enables the overall rocker arm 10 to have a lower height than corresponding rocker arms heretofore known, including that shown in the aforementioned patent application. The lower profile and compactness enable the rocker arm to be particularly adaptable for lower profile engines including lower profile valve trains. The use of the cam-contacting roller 64 to contact the cam 22 also reduces and minimizes friction therebetween. This reduces loads and results in better fuel economy or higher performance, in the alternative. The minimized friction also reduces wear. Further, because of the lower loads, the weight of the rocker arm can be reduced because stiffness is not as important.

Various modifications of the above-described embodiment of the invention will be apparent to those skilled in the art and it is to be understood that such modifications can be made without departing from the scope of the invention, if they are within the spirit and the tenor of the accompanying claims.

I claim:

1. In combination, a lifter post, a valve stem spaced from said lifter post, an overhead cam above and between said valve stem and said lifter post, and a one-piece, cold-formed rocker arm of the cam-follower type comprising a one-piece metal body having a rounded recess in a first end portion thereof receiving an end of said lifter post on which said rocker arm can pivot, said end portion having an opening extending therethrough communicating with said rounded recess and said opening forming an oil reservoir, said body having an additional recess of rectangular transverse cross-sectional shape at a second end portion thereof receiving an end of said valve stem, said body having an intermediate generally convex portion facing away from said recesses, said convex portion having a rectangular opening extending completely therethrough at a central portion thereof, side walls of said body at said convex portion having axially-aligned round openings therein, an axle extending through said round openings and affixed to said body for prevention of longitudinal movement of said axle, a multiplicity of needle bearings around said axle between ends thereof, and a roller rotatably mounted on said needle bearings and having a circumferential portion projecting outwardly from said rectangular opening and engaging said overhead cam, upper edges of said side walls of said body at said rectangular opening extending upwardly to meet at apexes near a middle portion of the longitudinal edges of said rectangular opening.

2. The combination according to claim 1 characterized by from one-fourth to one-third of the circumference of said roller projecting outwardly from said rectangular opening.

3. In combination, a lifter post, a valve stem spaced from said lifter post, an overhead cam above and between said valve stem and said lifter post, and a cold-formed rocker arm of the cam-follower type comprising a one-piece metal body of generally inverted U-shaped cross section throughout most of its length, said body having a top wall and two side walls extending downwardly therefrom and structurally integral therewith, said metal body having a rounded recess in a first end portion thereof receiving an end of said lifter post on which said rocker arm can pivot, said body having an additional recess at a second end portion thereof receiving an end of said valve stem, said body having an intermediate generally convex portion facing away from said recesses, said top wall having a rectangular opening therein at the convex portion, said rectangular opening extending substantially the width of the top wall between the side walls and having a length which is less than the longitudinal extent of the convex portion, said side walls of said body having axially-aligned round openings therein below said rectangular opening, an axle extending through said round openings and affixed to said side walls to prevent longitudinal movement of said axle, a roller located around said axle and extending between the side walls of said body, bearing means around said axle and within a bore of said roller to be rotatably mounted on said axle, and a portion of a circumferential surface of said roller projecting outwardly from said rectangular opening and engaging said cam.

4. The combination according to claim 3 characterized by said side walls at said convex portion of said body extending downwardly below the circumferential surface of said roller.

5. The combination according to claim 3 characterized by upper edges of said side walls of said body at said rectangular opening extending upwardly to meet at apexes near a middle portion of the longitudinal edges of said rectangular opening.

6. In combination, a lifter post, a valve stem spaced from said lifter post, an overhead cam, and a cold-formed rocker arm of the cam-follower type comprising a one-piece metal body of generally inverted U-shaped cross section throughout most of its length, said body having a top wall and two side walls extending downwardly therefrom and structurally integral therewith, said top wall having a rectangular opening at an intermediate portion thereof, said rectangular opening extending substantially the width of said top wall between the side walls and having a length which is less than the length of said top wall, said metal body having means at a first end portion thereof receiving an end of said lifter post on which said rocker arm can pivot, said body having additional means at a second end portion thereof receiving an end of said valve stem, said side walls of said body having axially-aligned round openings therein below said rectangular opening, outer portions of said round openings where they meet the outer surfaces of said side walls being flared outwardly, an axle extending through said round openings and having flared outer ends cooperating with the flared portions of said round openings to prevent longitudinal movement of said axle relative to said rocker arm body, a roller located around said axle and extending between the side walls of said body, said roller having a width slightly less than the width of said rectangular opening and having a diameter slightly less than the length of said rectangular opening, said roller engaging said overhead cam, and a multiplicity of needle bearings around said axle between ends thereof and within said roller to rotatably mount said roller on said axle.

7. The combination according to claim 6 characterized by said side walls of said rocker arm body extending downwardly below said roller.

8. The combination according to claim 6 characterized further by said means at said first end portion of said rocker arm body being a rounded recess receiving the end of the lifter post, and said additional means at said second end of said rocker arm body being an additional recess of rectangular transverse cross-sectional shape receiving the end of said valve stem, and said body having an intermediate generally convex portion facing away from said recesses in which said rectangular opening is located.

9. The combination according to claim 8 characterized by upper edges of said side walls of said body at said rectangular opening extending upwardly to meet at apexes near a middle portion of the longitudinal edges of said rectangular opening.

* * * * *